US006417621B1

(12) United States Patent
Hennings et al.

(10) Patent No.: US 6,417,621 B1
(45) Date of Patent: Jul. 9, 2002

(54) GAS DISCHARGE LAMP HAVING FERROELECTRIC CERAMIC ELECTRODES

(75) Inventors: Detlev Hennings; Oliver Steigelmann, both of Aachen (DE)

(73) Assignee: Koninklijke Philips Electronics N.V. (NL)

( * ) Notice: Subject to any disclaimer, the term of this patent is extended or adjusted under 35 U.S.C. 154(b) by 0 days.

(21) Appl. No.: 09/545,787

(22) Filed: Apr. 7, 2000

(30) Foreign Application Priority Data

Apr. 7, 1999 (DE) ..... 199 15 616

(51) Int. Cl.[7] ..... H01J 61/04

(52) U.S. Cl. ..... 313/633; 313/491; 313/623; 313/631

(58) Field of Search ..... 313/633, 491, 313/572, 574, 623, 624, 625, 626, 631, 630, 311, 332, 346 R, 352

(56) References Cited

U.S. PATENT DOCUMENTS 3,745,481 A * 7/1973 Erickson et al. ..... 331/94.5
5,654,606 A 8/1997 Weijtens et al. ..... 313/491
5,720,859 A * 2/1998 Czubarow et al. ..... 204/157.43

* cited by examiner

*Primary Examiner*—Vip Patel
*Assistant Examiner*—Joseph Williams
(74) *Attorney, Agent, or Firm*—Dicran Halajian; Frank J. Keegan

(57) ABSTRACT

A gas discharge lamp has electrodes of $Ba(Ti_{1-x}Zr_x)O_3$ with donor/acceptor dopants. Specific donor/acceptor combinations, an optimized content of zirconium and an optimized atomic ratio between the cations leads to ferroelectric ceramic exhibiting high values of the remnant polarization $P_r$ and the dielectric constant $\gamma_r$, as well as rectangular hysteresis loop and low coercive field strengths $E_c$. When an alternating voltage is applied to the ferroelectric electrodes, the non-linear properties of the electrodes bring about the ignition of the lamp as well as the continuous operation thereof.

4 Claims, 1 Drawing Sheet

GAS DISCHARGE LAMP HAVING FERROELECTRIC CERAMIC ELECTRODES

BACKGROUND OF THE INVENTION

The invention relates to a gas discharge lamp having electrodes of a ceramic material.

A gas discharge lamp comprises a radiation-transmitting discharge vessel which encloses a discharge space containing a gaseous, ionizable filling. Suitably spaced electrodes are arranged in this discharge space.

U.S. Pat. No. 5,654,606 discloses such a gas discharge lamp. Instead of the customary metal electrodes, a sintered mixture of metal and ceramic material is used as the coupling-in structure. By generating a high capacitive voltage between the coupling-in structures, the charge carriers are generated directly in the gas volume in such gas discharge lamps. The ceramic materials used required the addition of small quantities of metal to obtain sufficiently stable electrodes at temperature variations which may occur when such a gas discharge lamp is switched on.

SUMMARY OF THE INVENTION

According to the invention the electrodes are made of a ferroelectric ceramic.

A ceramic material for such electrodes must have a (substantially) rectangular hysteresis loop, a high dielectric constant $\in_r$ and a high remnant polarization $P_r$.

Most dielectric materials exhibit a low value of the dielectric constants $\in_r$ and a small field-dependence $\in_r$ (E). There are a few ferroelectric materials that are an exception to this rule; these materials exhibit $\in_r$ values which demonstrate a strong, discontinuous variation at a critical field intensity $E_c$.

Discs of ferroelectric materials, which exhibit a so-called non-linear behavior, can be used as electrodes in gas discharge lamps. These discs act as ceramic plate capacitors, and upon applying an alternating voltage, the inner surfaces are charged. The substantial, non-linear rise of the capacitor charge brings about the ignition and the subsequent continuous operation of the lamp.

Preferably, the ferroelectric ceramic comprises $Ba(Ti_{1-x}Zr_x)O_3$ doped with donor/acceptor combinations.

$Ba(Ti_{1-x}Zr_x)O_3$ doped with donor/acceptor combinations is a ferroelectric material having the required non-linear properties. In $Ba(Ti_{1-x}Zr_x)O_3$ mixed crystal ceramics, small additions of donor/acceptor combinations bring about high values of the remnant polarization $P_r$ and the dielectric constant $\in_r$. In addition, these donor/acceptor-doped $Ba(Ti_{1-x}Zr_x)O_3$ ceramics exhibit rectangular hysteresis loops.

It is preferred that the donor/acceptor combinations comprise $Mn^{3+}$ and $W^{6+}$ or $Yb^{3+}$ and $Nb^{5+}$ or $Yb^{3+}$ and $Mo^{6+}$ or $Mg^{2+}$ and $W^{6+}$ or $Mn^{3+}$ and $Nb^{5+}$ or $Yb^{3+}$ and $W^{6+}$ or $Mg^{2+}$ and $Nb^{5+}$ or $Mn^{3+}$ and $Dy^{3+}$, $Ho^{3+}$, $Er^{3+}$, $Gd^{3+}$, $Nd^{3+}$, $Y^{3+}$.

These donor/acceptor combinations bring about a particularly strong rise of the values of the dielectric constants $\in_r$ and the remnant polarization $P_r$.

It is also preferred that the zirconium content in the ferroelectric ceramic is x=0.09.

The addition of $BaZrO_3$ to $BaTiO_3$ causes the coercive field strengths in mixed crystals of the composition $Ba(Ti_{1-x}Zr_x)O_3$ to be reduced to $E_c$<100 V/mm. At an operating voltage of 220 V, this advantageously enables the use of coupling-in structures in a thickness such that a sufficient dielectric strength is obtained. At a zirconium content of x=0.09, the coercive field strength $E_c \approx 70$ V/mm, and the Curie temperature $T_c$ is 90° C., which temperature lies in a range above the operating temperature of gas discharge lamps.

It is further preferred that the ratio Ba/(Ti,Zr,dopants) lies in the range between 0.997 and 0.998.

In Perovskites, the atomic ratio between the cations has a large influence on the properties of the ceramic material. In the mixed crystal series $Ba(Ti_{1-x}Zr_x)O_3$, the largest increase of the dielectric constant $\in_r$ in dependence upon $E_c$ or $T_c$ is obtained when the atomic ratio Ba/(Ti,Zr,dopants) is slightly smaller than 1.

These and other aspects of the invention will be apparent from and elucidated with reference to the embodiment described hereinafter.

DETAILED DESCRIPTION OF THE PREFERRED EMBODIMENTS

Figure 1:
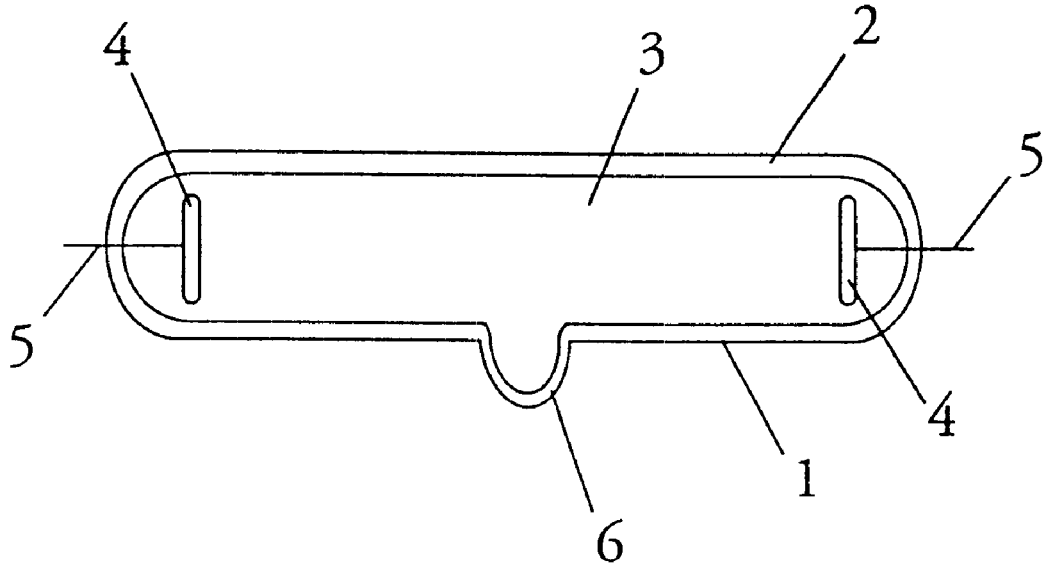
FIG. 1 is a longitudinal side view of an exemplary gas discharge lamp.

As shown in FIG. 1, a gas discharge lamp comprises a tubular discharge vessel 1, of, for example, lime glass, which encloses a discharge space 3 containing a gaseous, ionizable filling. The inner surface of the discharge vessel 1 is provided with a luminescent layer 2. The gaseous, ionizable filling may contain, for example, mercury and argon. Electrodes 4 of $Ba(Ti_{1-x}Zr_x)O_3$ doped with donor/acceptor combinations are arranged at a suitable distance from each other at opposite sides of the discharge vessel 1 in the discharge space 3. The electrodes 4 are each connected with a current supply 5, for example a metal pin. An integrated discharge aperture 6 is used to evacuate and fill the discharge vessel 1. When an alternating voltage is applied to both electrodes 4, which jointly act as a ceramic plate capacitor, the inner surfaces situated in the lamp are charged. The substantial, non-linear rise of the capacitor charge brings about the ignition as well as the subsequent continuous operation of the lamp. The ferroelectric material used for the electrodes 4 must meet the following requirements: high values of the remnant polarization $P_r$ and the dielectric constant $\gamma_r$, a rectangular hysteresis loop, a Curie temperature $T_c$ above the operating temperature of the lamp, and a coercive field strength $E_c$ below the operating voltage of 220 V.

$Ba(Ti_{1-x}Zr_x)O_3$ doped with donor/acceptor combinations is a material having the required non-linear properties. Typical acceptor dopants are $Mn^{3+}$, $Fe^{3+}$, $Cr^{3+}$, $Mg^{2+}$ and $Lu^{3+}$, which are inserted into the $Ti^{4+}$ and $Zr^{4+}$ sites of the Perovskite lattice. For the donors use can suitably be made of $Nb^{5+}$, $W^{6+}$, $Mo^{6+}$, $Mo^{5+}$ at the $Ti^{4+}$ and $Zr^{4+}$ sites, and $Y^{3+}$, $Dy^{3+}$, $Er^{3+}$, $Nd^{3+}$ and $Gd^{3+}$ can suitably be used at the $Ba^{2+}$ sites. Particularly advantageous are the combinations of $Mn^{3+}$ and $W^{6+}$ (3:1 to 2:1) or $Yb^{3+}$ and $Nb^{5+}$ (1.5:1) or $Yb^{3+}$ and $Mo^{6+}$ (2.5:1) or $Mg^{2+}$ and $W^{6+}$ (2.5:1) or $Mn^{3+}$ and $Nb^{5+}$ (1.5:1 to 1:1) or $Yb^{3+}$ and $W^{6+}$ (2.5:1) or $Mg^{2+}$ and $Nb^{5+}$ (1.5:1) or $Mn^{3+}$ and $Dy^{3+}$, $Ho^{3+}$, $Er^{3+}$, $Gd^{3+}$, $Nd^{3+}$, $Y^{3+}$ (1.5:1 to 1:1).

TABLE 1

Influence of dopants in $Ba(Ti_{0.91}Zr_{0.09})O_3$ (Σ contaminations ≅ 750 ppm, $T_{sinter}$ = 1450° C., Ba/(Ti, Zr, dopants) = 0.9975)

| dopant [mol %] | $\epsilon_r(T_c)$ | $\epsilon_r(E_c)$ | $Pr_r[\mu C/cm^2]$ | $E_c$ [V/mm] |
|---|---|---|---|---|
| — | 61000 | 760000 | 13 | 70 |
| 0.15 $Mn^{3+}$/0.10 $Nb^{5+}$ | 85000 | 1300000 | 14 | 60 |
| 0.10 $Mn^{3+}$/0.05 $W^{6+}$ | 90000 | 1500000 | 15 | 60 |
| 0.15 $Mn^{3+}$/0.1 $Y^{3+}$ | 90000 | 1400000 | 15 | 60 |
| 0.15 $Yb^{3+}$/0.1 $Mo^{6+}$ | 900000 | 1300000 | 15 | 60 |
| 0.15 $Yb^{3+}$/0.005 $W^{6+}$ | 1100000 | 2000000 | 16 | 60 |
| 0.15 $Mn^{3+}$/0.1 $Mo^{3+}$ | 95000 | 1500000 | 15 | 60 |
| 0.15 $Mg^{2+}$/0.1 $Nb^{5+}$ | 120000 | 3000000 | 17 | 65 |
| 0.15 $Mg^{2+}$/0.05 $W^{6+}$ | 120000 | 2800000 | 17 | 60 |

The properties of the ceramic material are also influenced by the zirconium content, the ratio between the cations as well as the sinter temperatures of the preparation, the purity of the raw materials and the chemical homogeneity of the ferroelectric material.

Ceramics of pure $BaTiO_3$ exhibit coercive field strengths of $E_c$>100 V/mm. In mixed crystals of the composition $Ba(Ti_{1-x}Zr_x)O_3$ the coercive field strengths decrease to values of $E_c$<100 V/mm.

When $BaZrO_3$ is added, the ferroelectric Curie temperature decreases by 4° C. per at. % from $T_c$=130° C. in pure $BaTiO_3$. At a zirconium content of x=0.09, the coercive field strength $E_c$≈70 V/mm and the Curie temperature $T_c$ is approximately 90° C.

In Perovskites, the ratio between the cations may have a substantial influence on the properties. In $BaTiO_3$, the atomic ratio of Ba/Ti exhibits a large influence on the sinterability and the dielectric properties of the ceramic materials. For example, at a ratio of Ba/Ti≈1, fine-grained ceramics having a high dielectric constant $\in_r$ are formed. In mixed crystals of the composition $Ba(Ti_{0.91}Zr_{0.09})O_3$, an increase of the dielectric constant $E_r$ in dependence upon $E_c$ or $T_c$ occurs when the atomic ratio is slightly smaller than 1.

TABLE 2

Influence of the atomic ratio Ba/(Ti, Zr) in $Ba(Ti_{0.91}Zr_{0.09})O_3$ (Σ contaminations ≅ 750 ppm, $T_{sinter}$ = 1450° C.)

| Ba/(Ti, Zr) | $\epsilon_r(T_c)$ | $\epsilon_r(E_c)$ |
|---|---|---|
| 0.999 | 28000 | 150000 |
| 0.998 | 53000 | 470000 |
| 0.997 | 61000 | 650000 |
| 0.995 | 45000 | 380000 |
| 0.990 | 38000 | 260000 |

The sintering temperatures in the manufacturing process as well as the purity of the raw materials, and the chemical homogeneity of the mixed crystal $Ba(Ti_{1-x}Zr_x)O_3$ have decisive influence on the values of the dielectric constant cr and the remnant polarization $P_r$ as well as on the trend of the hysteresis loop. Small contaminations or partially mixed raw materials already lead to a substantial reduction of the remnant polarity $P_r$ and to oblique hysteresis loops.

TABLE 3

Influence of the raw material purity and the sinter temperature on the dielectric constant $\epsilon_r$ at the Curie temperature $T_c$ and the coercive field strength $E_c$ in $Ba(Ti_{0.91}Zr_{0.09})O_3$

| Σ impurities [ppm] | $T_{sinter}$ [° C.] | $\epsilon_r(T_c)$ | $\epsilon_r(E_c)$ |
|---|---|---|---|
| 5000 | 1325 | 16000 | 50000 |
| 5000 | 1450 | 22000 | 110000 |
| 750 | 1325 | 18000 | 70000 |
| 750 | 1450 | 36000 | 210000 |

What is claimed is:

1. A gas discharge lamp comprising electrodes which are a ferroelectric ceramic, said ferroelectric ceramic comprising $Ba(Ti_{1-x}Zr_x)O_3$ doped with donor/acceptor combinations, where x=0.09.

2. A gas discharge lamp comprising electrodes which are a ferroelectric ceramic comprising $Ba(Ti_{1-x}Zr_x)O_3$ doped with donor/acceptor combinations, the ratio Ba/(Ti, Zr, dopants) being in the range between 0.997 and 0.998.

3. A gas discharge lamp comprising electrodes which are a ferroelectric ceramic connected to a current supply, the ferroelectric ceramic comprising $Ba(Ti_{1-x}Zr_x)O_3$ doped with donor/acceptor combinations, where x=0.09.

4. A gas discharge lamp comprising electrodes which are a ferroelectric ceramic connected to a current supply, the ferroelectric ceramic comprising $Ba(Ti_{1-x}Zr_x)O_3$ doped with donor/acceptor combinations, where the ratio Ba/(Ti, Zr, dopants) lies in the range between 0.997 and 0.998.

* * * * *